US008424591B2

(12) United States Patent
Creed et al.

(10) Patent No.: US 8,424,591 B2
(45) Date of Patent: Apr. 23, 2013

(54) TUBE SHEET ASSEMBLY

(75) Inventors: Edgar Noel Creed, Mossel Bay (ZA); Patrick Otto Taylor, Mossel Bay (ZA)

(73) Assignee: The Petroleum Oil and Gas Corporation of South Africa (Pty) Ltd, Parow (ZA)

( * ) Notice: Subject to any disclaimer, the term of this patent is extended or adjusted under 35 U.S.C. 154(b) by 167 days.

(21) Appl. No.: 12/743,665

(22) PCT Filed: Nov. 20, 2008

(86) PCT No.: PCT/IB2008/054875

§ 371 (c)(1), (2), (4) Date: Aug. 16, 2010

(87) PCT Pub. No.: WO2009/066260

PCT Pub. Date: May 28, 2009

(65) Prior Publication Data

US 2010/0294470 A1 Nov. 25, 2010

Related U.S. Application Data

(60) Provisional application No. 60/989,503, filed on Nov. 21, 2007.

(51) Int. Cl.
*F28F 19/00* (2006.01)
*F28F 9/04* (2006.01)

(52) U.S. Cl.
USPC ..... 165/134.1; 165/178

(58) Field of Classification Search ..... 165/178, 165/134.1
See application file for complete search history.

(56) References Cited

U.S. PATENT DOCUMENTS

| | | | | |
|---|---|---|---|---|
| 3,592,261 | A * | 7/1971 | Black | 165/178 |
| 3,982,585 | A * | 9/1976 | Gribsvad | 165/83 |
| 4,122,894 | A * | 10/1978 | Laws et al. | 165/76 |
| 4,442,052 | A | 4/1984 | Reynertson | |
| 4,449,575 | A * | 5/1984 | Laws et al. | 165/82 |
| 5,647,432 | A * | 7/1997 | Rexford et al. | 165/134.1 |
| 6,334,482 | B2 * | 1/2002 | Berglund et al. | 165/82 |
| 7,185,698 | B1 | 3/2007 | Bernert, Jr. et al. | |
| 2001/0040024 | A1 * | 11/2001 | Blanda et al. | 165/134.1 |

FOREIGN PATENT DOCUMENTS

| | | | |
|---|---|---|---|
| DE | 19536300 | C1 | 4/1997 |
| EP | 0777098 | A2 | 6/1997 |
| GB | 2266951 | A | 11/1993 |

* cited by examiner

*Primary Examiner* — Leonard R Leo
(74) *Attorney, Agent, or Firm* — The Webb Law Firm

(57) ABSTRACT

Disclosed is a tube sheet assembly for a waste heat boiler employed in a chemical process plant and which makes use of metal ferrules for protecting the inlets of the exchange tubes of the tube sheet. The tube sheet assembly includes at least one thermal insulator which is located inside an inlet opening of a tube sheet of the tube sheet assembly, and which covers a portion of a respective ferrule of the tube sheet assembly, thereby providing thermal insulation between the tube sheet and the ferrule.

16 Claims, 2 Drawing Sheets

TUBE SHEET ASSEMBLY

BACKGROUND TO THE INVENTION

1) Field of the Invention

This invention relates to a tube sheet assembly. In particular the invention is concerned with a tube sheet assembly for a waste heat boiler employed in a chemical process plant and which makes use of metal ferrules for protecting the inlets of the exchange tubes of the tube sheet.

2) Description of the Prior Art

Various types of chemical process plants employ heat exchangers or waste heat boilers for heat recovery and cooling. One example of a chemical process employing a waste heat boiler is a reforming process in which light hydrocarbons are converted into a gas mixture comprising carbon monoxide and hydrogen. In the reforming process the mixture of carbon monoxide and hydrogen is called synthesis gas or syngas. As the syngas is formed at high process temperatures it is necessary to dissipate large amounts of heat. This is often achieved with the use of waste heat boilers.

A waste heat boiler typically includes an inlet chamber into which a hot syngas stream can be fed from a transfer line. From the inlet chamber the syngas passes through exchange tubes extending between an inlet tube sheet and an outlet tube sheet. The exchange tubes are surrounded by circulating water such that the syngas is cooled as it passes along the exchanges tubes. The cooled syngas feeds into an outlet chamber from where it may be fed for further processing or can be subjected to another cooling cycle in a secondary heat recovery system operated in series with the waste heat boiler.

Due to the fact that the syngas entering the inlet chamber of the waste heat boiler will have a very high temperature, all components in contact with the syngas must be protected with thermal insulation. Accordingly the transfer line, inlet chamber and inlet tube sheet are provided with insulating lining, typically in the form of refractory lining.

All parts adjacent the joints between the inlet tube sheet and the exchange tubes are subjected to very severe conditions due to the fact that at these positions the syngas stream at its maximum temperature will be in contact with the inner surface of the exchange tubes. For this reason it is conventional practice to protect these parts with tube inserts, also known as ferrules. Generally the ferrules will be inserted into a tube sheet whereafter an insulation layer will be installed around the ferrules as well as on front of the tubesheet in order to provide insulation.

A problem often encountered with tube sheets is so-called metal dusting which refers to the catastrophic degradation of metals in carbonaceous gases, usually in operating temperatures of between 450° C. and 750° C. These high temperatures of tube sheets are of course a result of the high temperatures of the syngas passing therethrough en route to the exchange tubes.

Various solutions have in the past been proposed for addressing the problems associated with metal dusting of tube sheets. These solutions include providing dual layers of refractory castables having different thermal coefficients, installing felt washers between the refractory castable and the tube sheets, providing all ceramic ferrules as well as to provide ceramic ferrules with inner ceramic sleeves lined with fibre.

It is an object of the invention to provide an alternative tube sheet assembly for addressing the problem of metal dusting encountered with conventional tube sheet assemblies.

SUMMARY OF THE INVENTION

According to the present invention there is provided a tube sheet assembly which can be used in a waste heat boiler of a chemical process plant, the tube sheet assembly comprising a tube sheet for holding a plurality of exchange tubes, the tube sheet also defining a plurality of inlet openings through which a process fluid can pass from an inlet chamber of the waste heat boiler to the exchange tubes to undergo a cooling cycle, the tube sheet assembly including a plurality of ferrules which each extend through an inlet opening into a respective exchange tube, the tube sheet assembly being characterised in that at least one thermal insulator is at least partially located inside an inlet opening of the tube sheet for covering a portion of a respective ferrule thereby providing thermal insulation between the tube sheet and the ferrule.

Preferably the tube sheet assembly comprises a plurality of thermal insulators for providing thermal insulation between the tube sheet and a plurality of ferrules conveying hot process fluid to the exchange tubes.

More preferably the plurality of thermal insulators are secured in position inside the inlet openings with the use of insulation refractory.

Advantageously the thermal insulator is produced from a ceramic material.

Preferably, the thermal insulator is in the form of a sleeve having a bore for receiving a ferrule theretrough.

An annular flange may extend radially outwardly from a first end of the sleeve.

Typically the ferrules are covered with an insulation material such as high alumina ceramic fibre.

Preferably the insulation material on the ferrules is covered with a waterproof material.

According to a second aspect of the invention there is provided a tube sheet assembly which can be used in a waste heat boiler of a chemical process plant, the tube sheet assembly comprising a tube sheet for holding a plurality of exchange tubes through which a process fluid can pass from an inlet chamber of the waste heat boiler to undergo a cooling cycle, the tube sheet assembly including a plurality of ferrules which each extend into a respective exchange tube, the tube sheet assembly characterised therein that at least a portion of a ferrule is covered by insulation material, thereby providing thermal insulation between the tube sheet and the ferrule.

The invention also extends to a method of regulating the surface temperature of a tube sheet of a waster heat boiler.

BRIEF DESCRIPTION OF THE DRAWINGS

The invention will now be described in more detail, by way of example only, with reference to the accompanying drawings wherein.

DESCRIPTION OF THE ILLUSTRATED EMBODIMENT

Figure 1:
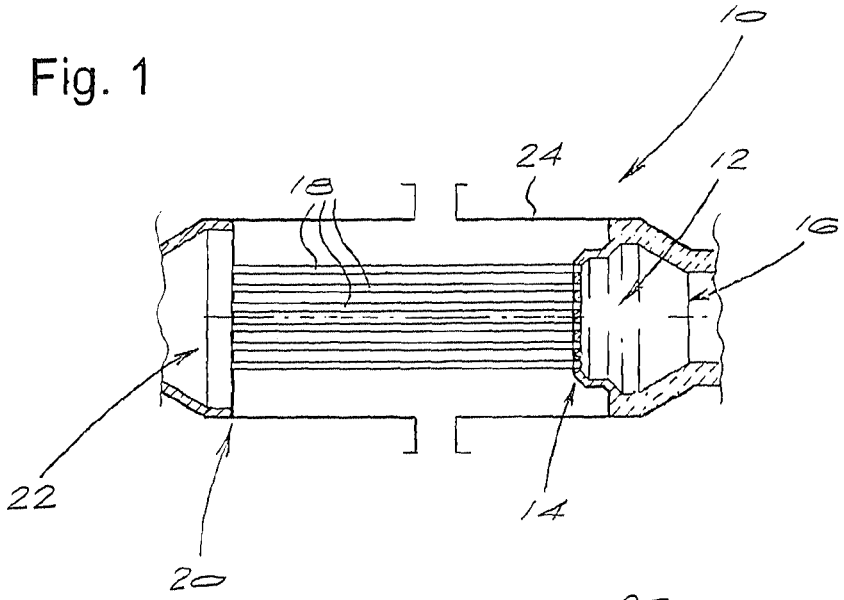
FIG. 1 shows a diagrammatic representation of a waste heat boiler including a tube sheet assembly in accordance with the present invention.

FIG. 1 shows a diagrammatic representation of a waste heat boiler, generally indicated with the reference numeral 10. The waste heat boiler 10 includes an inlet chamber 12 for providing fluid communication between an inlet tube sheet 14 and a transfer line 16 which can convey hot syngas. A plurality of heat exchange tubes 18 extend between the inlet tube sheet 14 and an outlet tube sheet 20. The outlet tube sheet 20 in turn is in fluid communication with an outlet chamber 22. In use the exchange tubes 18 will be surrounded with cooling water which will circulate inside a shell 24.

In use hot syngas emanating from a chemical process will be fed into the inlet chamber 12 of the waste heat boiler via the transfer line 16. From the inlet chamber 12 the syngas will pass through the inlet tube sheet 14 and into the exchange tubes 18. While passing through the exchange tubes 18 the syngas will be cooled under the influence of the cooling water circulating in the shell 24. Finally, the cooled syngas will exit the exchange tubes 18 at the outlet tube sheet 20 and feed into the outlet chamber 22. From the outlet chamber 22 the syngas can either undergo a further processing cycle or can be subjected to a further cooling process.

Figure 2:
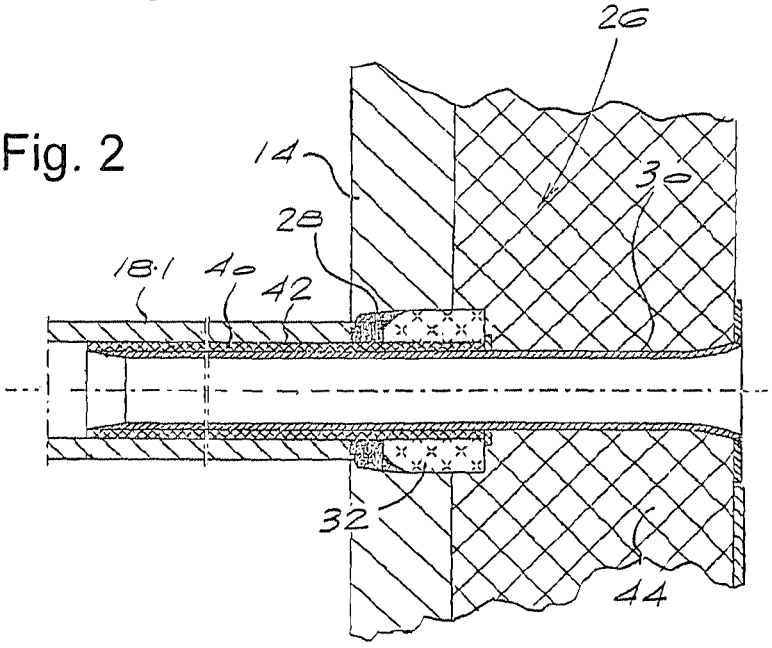
FIG. 2 shows an enlarged cross-sectional view of a portion of the tube sheet assembly of the invention.

FIG. 2 shows an enlarged view of a portion of the inlet tube sheet 14 of a tube sheet assembly in accordance with the present invention, generally indicated with the reference numeral 26. The tube sheet 14 defines an inlet opening 28 through which syngas can pass from the inlet chamber 12 to an exchange tube 18.1. In order to protect the portions of the tube sheet 14 defining the inlet opening 28 against the thermal effects of the hot syngas being fed to the exchange tube 18.1 a metal ferrule 30 is provided. The ferrule 30 is shaped as shown and extends from the inlet chamber 12 into a front portion of the exchange tube 18.1.

The object of the invention is to ensure that the surface temperature of the inlet tube sheet 14 is not allowed to move into the metal dusting range, which is typically between 450° C. and 750° C., thereby to avoid the unwanted effects associated with metal dusting. The invention proposes to address this objective by providing a thermal insulator 32 which can provide a thermal barrier between the inlet tube sheet 14 and the ferrule 30. In particular, the invention proposes in one embodiment that the thermal insulator 32 be sized such that at least a portion thereof can be located inside a cavity formed between the wall of the inlet tube sheet 14 which defines the inlet opening 38 and the outer surface of the ferrule 30. In use the thermal insulator 32 will serve to insulate the inlet tube sheet 14 against the thermal effects of the hot syngas being fed by the ferrule 30 into the exchange tube 18.1.

It is pointed out that the thermal insulator 32 need not be confined to the cavity inside the inlet tube sheet 14, but can extend therefrom as shown in FIG. 2. It is also envisaged that the thermal insulator can also be located on the face of the tubesheet only.

Figure 3:
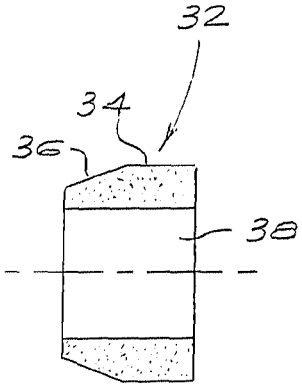
FIG. 3 shows a cross-sectional view of a thermal insulator for use in the thermal assembly of FIG. 2.

FIG. 3 provides a cross-sectional view of the thermal insulator 32. The thermal insulator 32 includes a cylindrical section 34 and a tapered section 36. A bore 38, which is suitably sized for accommodating the ferrule 30, extends from the one end of the thermal insulator 32 to the other end as shown. The thermal insulator 32 is here produced from a ceramic material, but it is envisaged that the thermal insulator could also be produced from a range of materials such as graphite and alumina.

Typical dimensions of the thermal insulator 32 include that it has an overall length of approximately 30 mm, a diameter of approximately 50 mm while the cylindrical section has a length of approximately 16.3 mm. The bore 38 has a diameter of approximately 30 mm while the tapered section tapers at an angle of approximately 20°. It will, however, be appreciated that the thermal insulator could have a range of dimensions.

It is pointed out that the thermal insulator 32 could be installed into the surface of the inlet tube sheet 14 or into the contour of a tube-to-tube joint.

The ferrule 30 is further wrapped in an insulation material 40, here provided in the form of high alumina ceramic fibre, typically of the type sold under the trademark Saffil®. The insulation material 40, in turn, is covered with waterproof tape 42.

The tube sheet assembly 26 also includes a layer of refractory material 44, here having a thickness of approximately 75 mm to 100 mm, for insulating the inlet tube sheet 14 against the thermal effects of the hot syngas fed to the exchange tubes 18. The refractory material 44 also aids in securing the thermal insulator 32 in position.

Figure 4:
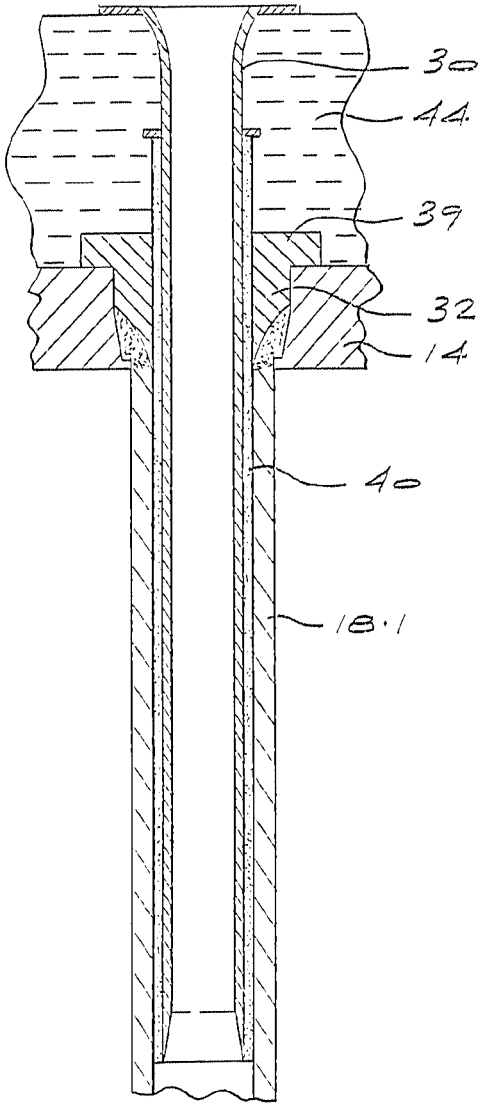
FIG. 4 shows an enlarged cross-sectional view of a further embodiment of the tube sheet in accordance with the invention.

A further embodiment of the tube sheet assembly 26 is shown in FIG. 4. In this example the thermal insulator 32 includes an annular flange 39 extending radially outwardly from an end of the insulator 32, and in use abuts a face of the tube sheet 14.

Figure 5:
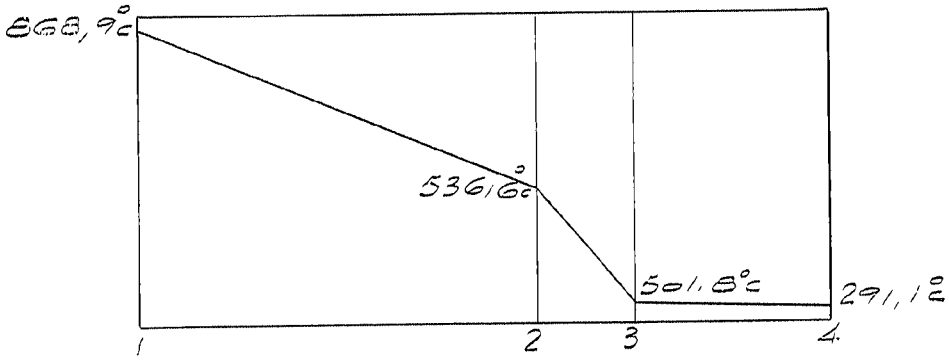
FIG. 5 shows the results of a thermal analysis done on the tube sheet assembly in accordance with the invention.

A tube sheet assembly in accordance with the above description will ensure that in use the temperature on the surface of the inlet tube sheet remain below the metal dusting range, provided the refractory installation is installed correctly. One example of a thermal analysis, showing the above tendency (which has also been proven in practice), is shown in FIG. 5. Zone 1-2 represents the refractory material (in this example having a thickness of 60 mm), Zone 2-3 represents the thermal insulator (having a thickness of 15 mm) and Zone 3-4 represents the tube sheet. It is clear from the temperature distribution that the surface of the tube sheet is sufficiently below the metal dusting range, and that the thermal insulator (Zone 2-3) plays a fundamental role in achieving this goal.

The invention claimed is:

1. A tube sheet assembly including:

a tube sheet for holding a plurality of heat exchange tubes, the tube sheet having a plurality of inlet openings through which a process fluid can pass into the heat exchange tubes, the tube sheet assembly including a plurality of ferrules, each extending through an inlet opening into a respective heat exchange tube; wherein each ferrule is covered by an insulating material, and a thermal insulator at least partially located inside an inlet opening of the tube sheet for covering a portion of a respective ferrule extending through the inlet opening, thereby providing thermal insulation between the tube sheet and the ferrule, wherein the thermal insulator is in the form of a sleeve having a bore for receiving a ferrule therethrough, and wherein an annular flange extends radially outward from a first end of the sleeve and abuts an outer face of the tube sheet.

2. The tube sheet assembly of claim 1, wherein the tube sheet forms part of a waste heat boiler used in a chemical process plant.

3. The tube sheet assembly of claim 2, wherein the tube sheet assembly includes a plurality of thermal insulators for providing thermal insulation between the tube sheet and a plurality of ferrules conveying hot process fluid to the exchange tubes.

4. The tube sheet assembly of claim 3, wherein each thermal insulator is secured inside the inlet opening by way of a layer of refractory material abutting against an end of the thermal insulator.

5. The tube sheet assembly of claim 3, wherein each thermal insulator is made of a ceramic material.

6. The tube sheet assembly of claim 2, wherein the thermal insulator is secured inside the inlet opening by way of a layer of refractory material abutting against an end of the thermal insulator.

7. The tube sheet assembly of claim 2, wherein each thermal insulator is made of a ceramic material.

8. The tube sheet assembly of claim 1, wherein the tube sheet assembly includes a plurality of thermal insulators for providing thermal insulation between the tube sheet and a plurality of ferrules conveying hot process fluid to the exchange tubes.

9. The tube sheet assembly of claim 8, wherein each thermal insulator is secured inside the inlet opening by way of a layer of refractory material abutting against an end of the thermal insulator.

10. The tube sheet assembly of claim 8, wherein each thermal insulator is made of a ceramic material.

11. A heat exchanger including a tube sheet assembly as claimed in claim 8.

12. The tube sheet assembly of claim 1, wherein the thermal insulator is secured inside the inlet opening by way of a layer of refractory material abutting against an end of the thermal insulator.

13. The tube sheet assembly of claim 1, wherein the thermal insulator is made of a ceramic material.

14. The tube sheet assembly of claim 1, wherein the ferrules are covered with high alumina ceramic fibre.

15. The tube sheet assembly of claim 14, wherein the insulation material on the ferrules is covered with a waterproof material.

16. A heat exchanger including a tube sheet assembly as claimed in claim 1.

* * * * *

UNITED STATES PATENT AND TRADEMARK OFFICE

CERTIFICATE OF CORRECTION

PATENT NO. : 8,424,591 B2
APPLICATION NO. : 12/743665
DATED : April 23, 2013
INVENTOR(S) : Creed et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 254 days.

Signed and Sealed this
Eighth Day of September, 2015

Michelle K. Lee

Michelle K. Lee
*Director of the United States Patent and Trademark Office*